United States Patent [19]

Ashley et al.

[11] Patent Number: 4,930,322

[45] Date of Patent: Jun. 5, 1990

[54] ADVANCED HEAT PUMP

[75] Inventors: Joseph L. Ashley, Fairfax, Va.; John D. Matthews, Simi Valley, Calif.

[73] Assignee: The United States of America as represented by the Secretary of the Navy, Washington, D.C.

[21] Appl. No.: 405,828

[22] Filed: Sep. 11, 1989

[51] Int. Cl.[5] ..... F25D 21/00

[52] U.S. Cl. ..... 62/271; 62/92

[58] Field of Search ..... 62/271, 93, 94, 91, 62/324.1, 324.5; 237/2 B

[56] References Cited

U.S. PATENT DOCUMENTS

| | | | |
|---|---|---|---|
| 175,291 | 3/1876 | Lount . | |
| 3,417,574 | 12/1968 | Kelley . | |
| 4,205,529 | 6/1980 | Ko . | |
| 4,240,269 | 12/1980 | Bussijager . | |
| 4,430,864 | 2/1984 | Mathiprakasam | 62/94 |
| 4,598,558 | 7/1986 | Bingham | 62/324.4 |
| 4,793,143 | 12/1988 | Rhodes | 62/93 |

FOREIGN PATENT DOCUMENTS

| | | | |
|---|---|---|---|
| 57-28934 | 2/1982 | Japan | 62/94 |

*Primary Examiner*—Albert J. Makay
*Assistant Examiner*—John Sollecito
*Attorney, Agent, or Firm*—David S. Kalmbaugh

[57] ABSTRACT

A heat pump is disclosed which includes a first packed bed of liquid desiccant for removing moisture from outside air in the heating mode of operation, and a pump for transferring the moisture laden desiccant to a second packed bed which humidifies condenser heated inside air by adding water vapor to the air. The first packed bed, by removing moisture from the outside air before it passes through the heat pump's evaporator coils, prevents frost from forming on the coils. In the cooling mode of operation the second packed bed of liquid desiccant removes water vapor from the air inside of the building. The moisture laden desiccant is then transferred to the first packed bed by a second pump where condenser heat transfers the moisture from the desiccant to outside air.

14 Claims, 1 Drawing Sheet

ADVANCED HEAT PUMP

BACKGROUND OF THE INVENTION

1. Field of the Invention

This invention relates generally to heat pumps. In particular, this invention relates to an advanced heat pump which uses a liquid desiccant to remove moisture from outside air and then transfer the moisture to dry heated air inside of a building.

2. Description of the Prior Art and Objectives of the Invention

Engineers have known for many years that the evaporator and condenser in refrigeration equipment can be interchanged by reversing the direction of the refrigerant flow from the compressor. By reversing the flow direction either a heating or cooling function can be performed and such refrigeration equipment which is commonly referred to as a heat pump generally includes an outdoor coil which is positioned on the exterior of the building, an indoor coil positioned within the building and an expansion valve for reducing the pressure of the refrigerant. Both the indoor and outdoor coil function as a condenser or as an evaporator depending on whether the heat pump is operating in a cooling cycle or a heating cycle.

Various types of heat pumps having reverse refrigeration cycles which may be either self contained or split (condenser and evaporator in separate locations) have met with moderate success in certain installations, but have also had certain disadvantages. For example, conventional heat pumps use freon or refrigerants with relative high boiling temperatures (boiling point between 0° F. and 32° F.) to inhibit frost formation on evaporator surfaces when the outside air temperature falls below 40° F. In addition, these heat pumps generally require another heat source such as electric heating coils to melt frost accumulations on evaporators. This generally limits the use of conventional heat pumps to geographic regions having mild winters such as Virginia, Maryland and North Carolina. Further, conventional heat pump systems dehumidify the air during the heating mode of operative often requiring the installation of complex and expensive auxiliary equipment to maintain a suitable interior building humidity.

With these and other disadvantages known to conventional heat pump systems, the present invention was conceived and one of its objectives is to provide a heat pump which is economical to use and provides satisfactory results and low maintenance and operating cost for the user.

It is another object of the present invention to provide a heat pump which removes water vapor from outside air and thereby prevents frost formation on a cold evaporator.

It is still another object of the present invention to utilize the condensation collected from the outside air to humidify air inside of a building during the heating cycle.

It is yet another object of the present invention to provide a heat pump which uses low temperature boiling point refrigerants to improve operating efficiency and provide for operability in cold weather geographic locations.

Various other advantages and objectives will become apparent to those skilled in the art as a more detailed description of the invention is set forth below.

SUMMARY OF THE INVENTION

The aforesaid and other objects of the invention are accomplished by utilizing a heat pump which comprises a first packed bed of liquid desiccant which removes water vapor from outside air in the heating mode of operation. The moisture laden desiccant is then transferred to a second packed bed which adds water vapor to condenser heated inside air thereby heating and humidifying a building's interior. In addition, the first packed bed by removing moisture from the outside air before it passes through the heat pump's evaporator coils prevents frost from forming on the evaporator coils.

In the cooling cycle the second packed bed of liquid desiccant removes water vapor from the air inside of the building. The moisture laden desiccant is then transferred to the first packed bed where condenser heat transfers the moisture from the desiccant to the outside air.

DESCRIPTION OF THE PREFERRED EMBODIMENT

Figure 1:
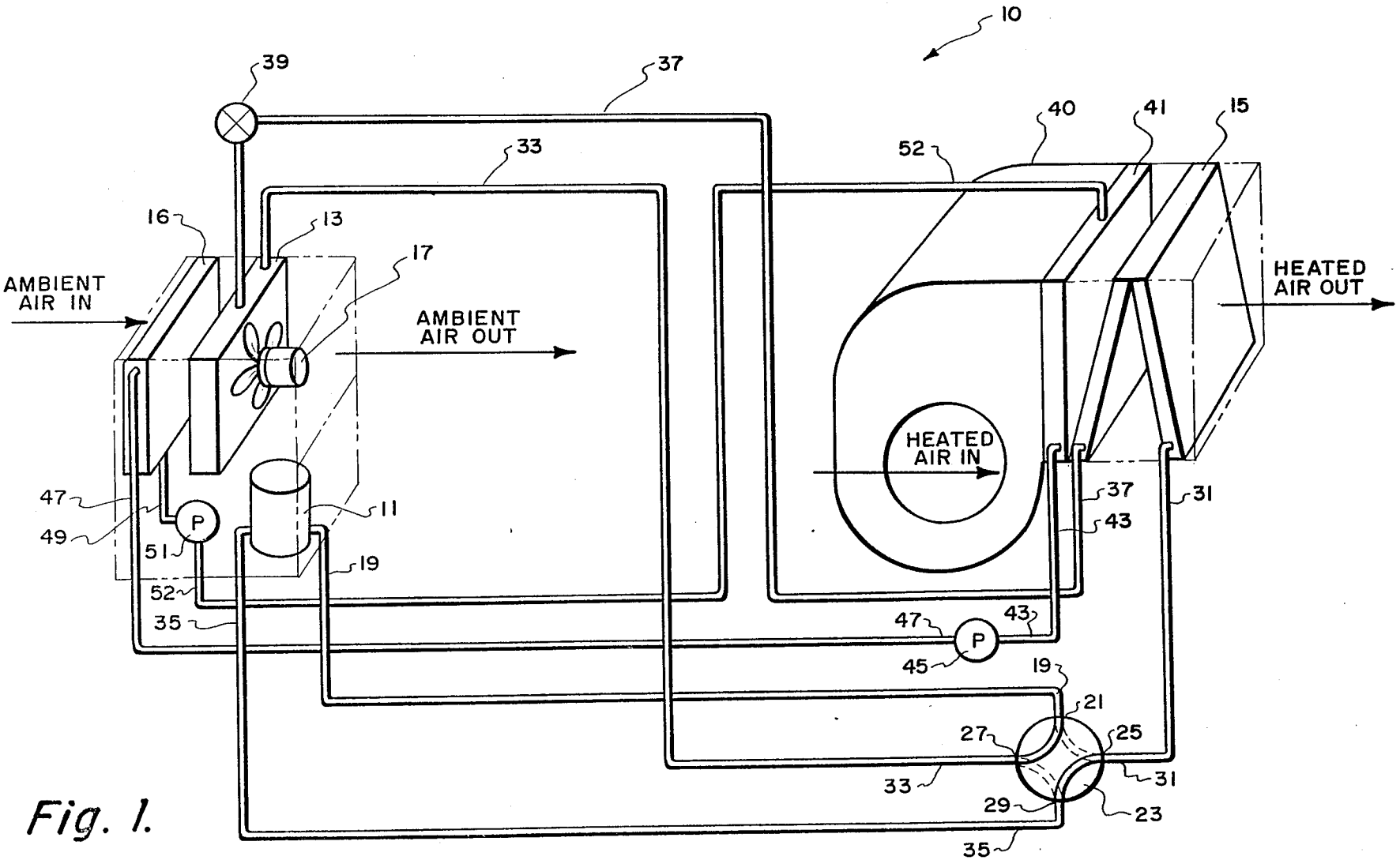
FIG. 1 is a diagrammatic view of an advanced heat pump constituting the present invention.

The preferred embodiment of the subject invention will now be discussed in some detail in conjunction with all of the figures of the drawing, wherein like parts are designated by like reference numerals.

Referring to FIG. 1, there is shown an advanced heat pump system 10 which includes a compressor 11 and two condenser-evaporators 13 and 15. Condenser-evaporator 13 represents an outdoor coil and condenser-evaporator 15 represents an indoor coil.

It is to be understood that the following discussion is with respect to the heating mode of operation of heat pump 10. Positioned on one side of condenser-evaporator 13 is a packed bed 16 which uses a desiccant such as triethylene glycol, lithium bromide or ethylene glycol to remove from outside/ambient air moisture thereby drying the outside air and raising the temperature of the outside air since latent heat caused by condensation of water is released to the air during the drying process. At this time it should be noted that heat pump 10 may use a spray tower or a chamber instead of a packed bed to remove moisture from outside air.

A fan 17, positioned on the opposite side of condenser-evaporator 13, draws outside air through packed bed 16 and condenser-evaporator 13 which changes a liquid refrigerant such as a low boiling point freon (a boiling point of 0° C. or less) to a vaporous refrigerant gas.

It should be noted at this time that whenever the outside temperature drops below 40° F. (4° C.) the operation of heat pump 10 is maintained since the desiccant has removed from the outside air moisture thereby preventing the formation of frost on condenser-evaporator 13.

Compressor 11 has a discharge port connected by a conduit 19 to a port 21 of a reversible four-way valve 23. Reversible four-way valve 23 includes a movable element within a sealed casing which can be positioned to change the flow path between flow lines connected to the valve.

Four-way valve 23 also includes ports or conduit connections 25, 27 and 29. Port 25 of valve 23 is connected by a conduit 31 to the first inlet-outlet port of condenser-evaporator 15, while port 27 of valve 23 is connected by conduit 33 to the first inlet-outlet port of condenser-evaporator 13. Port 29 of valve 23 is connected by a conduit 35 to the inlet port of compressor 11. The second inlet-outlet port of condenser-evaporator 15 is connected by a conduit 37 through an expansion valve 39 to the second inlet-outlet port of condenser-evaporator 13.

When heat pump 10 is in the heating mode of operation, compressor 11 compresses the vaporous gas to provide a high pressure, high temperature refrigerant gas (a temperature range sufficient for a heating system operating between 60° F. and 75° F.).

When condenser-evaporator 15 functions as a condenser, that is when the system is in the heating mode of operation, valve 23 is in the position shown by dotted lines. The high pressure refrigerant gas provided by compressor 11 flows through conduit 19, valve 23, and conduit 31 to condenser-evaporator 15. Room return air from the building being heated is driven by an air blower 40, positioned adjacent condenser-evaporator 15, through condenser-evaporator 15 which then provides heat to warm the room air passing thereacross. The warm air is then circulated through the building being heated.

The refrigerant liquid exits condenser-evaporator 15 through conduit 37 into expansion valve 39. Expansion valve 39 reduces the pressure of the liquid refrigerant prior to entry of the refrigerant into condenser-evaporator 13 where the refrigerant is again evaporated to a vaporous gas.

Positioned between condenser-evaporator 15 and air blower 40 is a packed bed 41. Packed bed 41 has an inlet port which is connected by a conduit 43 to the discharge port of a pump 45, with the inlet port of pump 45 being connected by a conduit 47 to the outlet port of packed bed 16. The inlet port of packed bed 16 is connected by a conduit 49 to the discharge port of a pump 51 with the inlet port of pump 51 being connected by a conduit 52 to the outlet port of packed bed 41.

When heat pump 10 is in the heating mode of operation, room return air driven by blower 40 flows through packed bed 41 where the room return air warms the moisture laden desiccant transferred by pump 45 from packed bed 16 to packed bed 41. Warming the moisture laden desiccant draws moisture from the desiccant to the room return air, thereby humidifying the air used to heat the building's interior. The dry desiccant is then transferred from packed bed 41 to packed bed 16 by pump 51 where the dry desiccant again removes moisture from outside/ambient air.

It is to be understood that the following discussion is with respect to the cooling mode of operation of heat pump 10.

When condenser-evaporator 13 operates as a condenser, that is heat pump 10 is in a cooling mode of operation, valve 23 is in the position shown by solid lines. The refrigerant direction is reversed from that as described in the heating cycle.

The high pressure refrigerant gas first passes from compressor 11 through valve 23 to condenser-evaporator 13. Warm ambient air condenses and cools the refrigerant to a liquid which then passes through valve 39, where the pressure is dropped expanding the liquid. The liquid refrigerant flows through conduit 37 to condenser-evaporator 15, which acts as an evaporator thereby cooling the interior of the building and evaporating the liquid to a gas. The refrigerant gas returns to compressor 11 through conduit 31, valve 23, and conduit 35, where the cooling cycle is repeated. When heat pump 10 is in the heating mode of operation, the desiccant in packed bed 41 removes moisture from the cool room air driven through packed bed 41 by air blower 40. The moisture laden desiccant is then transferred by pump 51 to packed bed 16. Warm ambient air is drawn through packed bed 16 releasing moisture from the desiccant to the ambient air. The dry desiccant is then transferred from packed bed 16 to packed bed 41 by pump 45 where the cycle described above is repeated.

While the present invention has been illustrated in accordance with a preferred embodiment, it is recognized that variations and changes may be made therein without departing from the invention as set forth in the claims.

What is claimed is:

1. A heat pump having a reversible refrigerant cycle for heating and cooling the interior of a building, comprising;

a compressor having an inlet port and a discharge port;

a first condenser-evaporator having first and second inlet-outlet ports;

a second condenser-evaporator having first and second inlet-outlet ports, the first inlet-outlet port of which is connected to the first inlet-outlet port of said first condenser-evaporator;

reversing means having a first port connected to the discharge port of said compressor, a second port connected to the inlet port of said compressor, a third port connected to the second inlet-outlet port of said first condenser-evaporator, and a fourth port connected to the second inlet-outlet port of said second condenser-evaporator for directing a refrigerant to said condenser-evaporator functioning as a condenser and for receiving said refrigerant from said condenser-evaporator functioning as an evaporator;

means connected between the first inlet-outlet port of said first condenser-evaporator and the first inlet-outlet port of said second condenser-evaporator for expanding said refrigerant flowing into said condenser-evaporator functioning as an evaporator;

means positioned adjacent said first condenser-evaporator for drawing outside air through said first condenser-evaporator;

means positioned adjacent said second condenser-evaporator for forcing inside air through said second condenser-evaporator;

first transferring means positioned adjacent said first condenser-evaporator for removing moisture from outside air to a desiccant when said heat pump is heating said building and for removing moisture from said desiccant to outside air when said heat pump is cooling said building;

second transferring means positioned adjacent said second condenser-evaporator for drawing moisture from said desiccant to inside air when said heat pump is heating said building and for removing moisture from inside air to said desiccant when said heat pump is cooling said building; and pumping means connected to said first and second transferring means for directing said moisture laden desiccant from said first transferring means to said second transferring means when said heat pump is heating said building and for directing said moisture laden desiccant from said second transferring means to said first transferring means when said heat pump is cooling said building.

2. The heat pump in accordance with claim 1 wherein said reversing means is a four-way valve.

3. The heat pump in accordance with claim 1 wherein said first and second transferring means each comprise a packed bed.

4. The heat pump in accordance with claim 1 wherein said pumping means comprises:

a first pump having an inlet port connected to an outlet port of said first transferring means and a discharge port connected to an inlet port of said second transferring means; and a second pump having an inlet port connected to an outlet port of said second transferring means and a discharge port connected to an inlet port of said first transferring means.

5. The heat pump in accordance with claim 1 wherein said desiccant comprises triethylene glycol.

6. The heat pump in accordance with claim 1 wherein said desiccant comprises lithium bromide.

7. The heat pump in accordance with claim 1 wherein said desiccant comprises ethylene glycol.

8. A heat pump system for humidifying the interior of a building when in a heating mode of operation and for dehumidifying the interior of said building when in a cooling mode of operation, comprising:

a compressor having an inlet port and a discharge port;

a first condenser-evaporator having first and second inlet-outlet ports;

a second condenser-evaporator having first and second inlet-outlet ports, the first inlet-outlet port of which is connected to the first inlet-outlet port of said first condenser-evaporator;

an expansion valve connected between the first inlet-outlet port of said first condenser-evaporator and the first inlet-outlet port of said second condenser-evaporator;

a fan positioned on one side of said first condenser-evaporator for drawing outside air through said first condenser-evaporator;

an air blower positioned adjacent said second condenser-evaporator for driving inside air through said second condenser-evaporator;

a four-way valve having a first port connected to the discharge port of said compressor, a second port connected to the inlet port of said compressor, a third port connected to the second inlet-outlet port of said first condenser-evaporator, and a fourth port connected to the second inlet-outlet port of said second condenser-evaporator;

first transferring means positioned on the opposite side of said first condenser-evaporator for removing moisture from outside air to a desiccant when said heat pump is in the heating mode of operation thereby preventing the formation of frost on said first condenser-evaporator and for removing moisture from said desiccant to outside air when said heat pump is in the cooling mode of operation;

second transferring means positioned between said second condenser-evaporator and said air blower for drawing moisture from said desiccant to inside air thereby humidifying the inside air when said heat pump is in the heating mode of operation and for removing moisture from inside air to said desiccant thereby dehumidifying the inside air when said heat pump is in the cooling mode of operation; and pumping means connected to said first and second transferring means for directing said moisture laden desiccant from said first transferring means to said second transferring means when said heat pump is heating said building and for directing said moisture laden desiccant from said second transferring means to said first transferring means when said heat pump is cooling said building.

9. The heat pump in accordance with claim 8 wherein said first and second transferring means each comprise a packed bed.

10. The heat pump in accordance with claim 8 wherein said pumping means comprises:

a first pump having an inlet port connected to an outlet port of said first transferring means and a discharge port connected to an inlet port of said second transferring means; and a second pump having an inlet port connected to an outlet port of said second transferring means and a discharge port connected to an inlet port of said first transferring means.

11. The heat pump in accordance with claim 8 wherein said desiccant comprises triethylene glycol.

12. The heat pump in accordance with claim 8 wherein said desiccant comprises lithium bromide.

13. The heat pump in accordance with claim 8 wherein said desiccant comprises ethylene glycol.

14. A heat pump system for heating and cooling the interior of a building comprising:

a compressor having an inlet port and a discharge port;

a first condenser-evaporator having first and second inlet-outlet ports;

a second condenser-evaporator having first and second inlet-outlet ports, the first inlet-outlet port of which is connected to the first inlet-outlet port of said first condenser-evaporator;

an expansion valve connected between the first inlet-outlet port of said first condenser-evaporator and the first inlet-outlet port of said second condenser-evaporator;

a four-way valve having a first port connected to the discharge port of said compressor, a second port connected to the inlet port of said compressor, a third port connected to the second inlet-outlet port of said first condenser-evaporator, and a fourth port connected to the second inlet-outlet port of said second condenser-evaporator;

a first packed bed positioned on one side of said first condenser-evaporator, said first packed bed having an inlet port and an outlet port;

a fan positioned on the opposite side of said first condenser-evaporator;

an air blower positioned adjacent said second condenser-evaporator;

a second packed bed positioned between said air blower and said second condenser-evaporator, said second packed bed having an inlet port and an outlet port;

a first pump having an inlet port connected to the outlet port of said first packed bed and a discharge port connected to the inlet port of said second packed bed; and a second pump having an inlet port connected to the outlet port of said second packed bed and a discharge port connected to the inlet port of first packed bed.

* * * * *